United States Patent [19]

Sandow

[11] Patent Number: 4,703,596

[45] Date of Patent: Nov. 3, 1987

[54] GRID SKYLIGHT SYSTEM

[75] Inventor: Kiyoshi Sandow, Crosby, Tex.

[73] Assignee: Plasteco, Inc., Houston, Tex.

[21] Appl. No.: 908,037

[22] Filed: Sep. 16, 1986

[51] Int. Cl.[4] ..... E04B 7/18

[52] U.S. Cl. ..... 52/200

[58] Field of Search ..... 52/200, 80

[56] References Cited

U.S. PATENT DOCUMENTS

| | | | |
|---|---|---|---|
| 3,107,864 | 10/1963 | Kinnear | 52/200 |
| 3,791,088 | 2/1974 | Sandow | 52/200 |
| 4,114,330 | 9/1978 | Sukolics | 52/200 |
| 4,123,883 | 11/1978 | Barber | 52/200 |
| 4,614,067 | 9/1986 | Matsubara | 52/200 |
| 4,621,466 | 11/1986 | Sonneborn | 52/200 |

*Primary Examiner*—Henry E. Raduazo

*Attorney, Agent, or Firm*—Pravel, Gambrell, Hewitt, Kimball & Krieger

[57] ABSTRACT

A grid skylight support apparatus includes a plurality of prefabricated grid row frames, each formed of a plurality of connected beam supports which define a plurality of bays. Each respective bay has a skylight curb formed by upper flanges of the beam supports that is receptive of a preassembled skylight unit. The sides of each grid row frame provide a mating edge that can register with the mating edge of an adjacent grid row frame during field assembly. The skylights have peripheral support skirts that register upon each bay and a light-transmitting skylight panel which covers the peripheral support. A plurality of cross gutters on each grid row frame, and positioned between adjacent skylights, extends at an angle toward the mating edge of the grid row frame for carrying rainwater to a main gutter channel which is formed by field-assembly of the mating edges of two adjacent grid row frames. The main gutter channel includes a pair of longitudinally extending gutter sections, each having a main gutter channel surface with a lower elevation than the elevation of the cross flow channel. A discharge transmits rainwater flow between the cross gutters and the main gutter channel. Fasteners assemble the grid row frame mating edges together and a continuous seal prevents rainwater leakage at the mating edges of adjacent grid row frames. Rainwater flowing from the skylights thus drains into the cross gutters or main gutters to eliminate the formation of standing water, always a source of potential leakage. The use of relative by lightweight grid row frames (minus skylights) permits easier job site handling and installation of the overall grid support. Individually installed skylights permit selection and installation of fixed units or individually operable (ventable) units.

14 Claims, 9 Drawing Figures

GRID SKYLIGHT SYSTEM

BACKGROUND OF THE INVENTION

The present invention relates to grid skylight systems and more particularly to a grid skylight system having prefabricated curb and gutter frames formed of interconnected longitudinal and transverse beams that form higher transverse cross gutters that drain into lower, longitudinal main gutters. The lightweight grid frames are prefabricated rows that can be easily field installed to form an overall grid support. Assembly between adjoining grid row frames is made watertight by a continuous gasket seal and the assembly of mating edges of adjacent grid row frames forms the main gutter channel.

Many constructions use skylights or glass covering structures as roofs for large buildings or at least for covering a portion of a large building. Skylights are commonly used to cover large atrium spaces. One common type of skylight includes a plurality of separate panels which can be flat, dome shaped, pyramidal, or the like. Such multiple or grid skylight systems require some type of gutter system for channeling rainwater to a desired discharge. A typical gutter system includes a number of intersecting gutters, normally positioned between adjacent individual skylights. The gutters are usually constructed in the field and upon the atrium space to be covered by using welding or fasteners such as sheetmetal screws, bolting, or the like. The field construction of a skylight system increases labor costs and the complexity of installation. Additionally, a typical field-installation contemplates the individual skylight units to be of a permanent part of the structure which often makes replacement of an individual skylight unit difficult or impossible.

Various skylight constructions including some grid skylight systems have been patented. For example, U.S. Pat. No. 4,194,325 issued to Chalpin shows a skylight and gutter system that uses an elevated cross gutter in combination with main gutters. The Chalpin patent provides a gutter system for skylights which includes a formed or extruded primary gutter and a channel connector shop welded across the primary gutter at locations where a secondary gutter is desired. A secondary gutter is nested in the connector and is attached thereto. The channel connector has a drainhole defined therein for conducting water from the secondary gutter to the primary gutter. However, the gutter and cross gutter configuration disclosed in Chalpin must be field assembled which differs from the present invention wherein individual frame rows of a given number of skylight supports are prefabricated and then field-assembled to form a grid or array that supports a plurality of skylights. The present invention features adjoining mating edges of grid row frames to form a continuous main channel for rainwater.

U.S. Pat. No. 3,791,088 issued Feb. 12, 1974 to K. Sandow and Thomas Anderton provides a grid skylight systems that includes longitudinal main channels for carrying rainwater as well as a plurality of cross flow gutters. A clamp assembly secures the cross gutters and adjoining main gutters together with a clamp assembly that also secures the skylight domes. This construction requires a complete disassembly of the clamping arrangement in order to remove a single skylight dome for replacement. The '088 patent uses longitudinal frame members and lateral end frame members which join. A cover plate with assembly screws forms the clamp that is used to secure the plexiglass or acrylic domes in position upon the network of longitudinal frames and lateral frames.

The Dietrich Pat. No. 4,471,584 discloses a skylight system of preglazed modules which are factory preassembled and shipped to a job site for erection directly onto a supporting structure. The modules are interconnected with joints that allow for thermal expansion. The preglazed assemblies can be individually replaced when broken. Gutters are provided on adjacent modules and joined to provide a continuous moisture removal system for condensate and leakage. This patent uses a complicated interfitted tongue and groove joint. The system is installed by inserting weatherstripping between adjacent modules. This is different from the present invention wherein all water drains from individual domed skylights to cross gutters and to main gutters. The present invention also differs from the Dietrich patent by providing individual grid row frames which can be prefabricated and can be field-assembled to form an overall grid skylight support wherein mating edges of the adjacent grid row frames assemble to form the main gutter channel between adjacent grid row frames.

Thus, the present invention provides an improved grid skylight apparatus having a plurality of grid row frames, each comprising a preferably self-supporting plurality of interconnected beam supports defining a plurality of individual bays with the bay upper surfaces forming individual skylight curbs that respectively support a plurality of skylights. The side of each grid row frame provides a mating edge that can register with the mating edge of an adjacent grid row frame during assembly. A plurality of skylights, each having a peripheral support skirt seats respectively upon each bay at the skylight curb associated therewith, and a light transmitting skylight panel covers the peripheral support. A plurality of cross gutters is provided on each grid row, preferably upon one of the connected beam supports and is positioned between adjacent skylights, the cross gutter extending at an angle toward the mating edge of the grid row. A cross flow channel surface on the cross gutter provides an elevation lower than the bay upper surfaces defining the skylight curbs. A main gutter channel is formed by an assembly of the mating edges of two adjacent grid row frames and includes a pair of longitudinally extending gutter sections, each having a main gutter channel surface with an elevation lower than the elevation of the cross flow channel surface. The gutter sections include beam support flanges defining one side of each bay and an assembly flange extending upwardly from the main gutter channel surface. A discharge transmits rainwater flow between the cross gutters and the main gutter channel. Fasteners are provided for assembling the grid row mating edges and a continuous seal prevents rainwater leakage at the mating edges of adjacent grid rows.

In the preferred embodiment, each main gutter includes a pair of longitudinal beams, having corresponding cross sections that include an upper flange comprising in part the skylight curbs for supporting the skylights, a lower flange defining the bottom of the main gutter channel, an inner vertical web extending between the upper flange and the lower flange, and generally vertical assembly flange transversely spaced from the inner vertical web. The assembly flanges include the mating edges which align when adjacent grid row frames are assembled. In the preferred embodiment, each assembly flange extends from the lower flange that defines the bottom of the main gutter channel and terminates at an elevation position below the upper flange that defines the skylight curb surface. In the preferred embodiment, a seal includes a continuous longitudinal gasket that extends between the assembly flanges of adjacent longitudinal beams of adjacent assembled grid rows. Each grid row preferably comprises a plurality of interconnected longitudinal and transverse beam supports, each having an upper flange that occupies the same plane to define the individual skylight curbs. In the preferred embodiment, the longitudinal beams and transverse beams intersect at right angles and have connected upper horizontal flanges forming rectangular skylight curbs upon which the skylight peripheral support members register.

In the preferred embodiment, each cross gutter comprises a generally U-shaped beam member having a pair of spaced apart upper flanged portions with spaced apart surfaces that define a portion of the skylight curbs for adjacent skylights. The use of spaced apart flanges insures that individual skylights can be operated and/or replaced and allows rain flow to travel from each skylight directly into the cross flow channels.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF A PREFERRED EMBODIMENT

Figures 1, 2, 3:
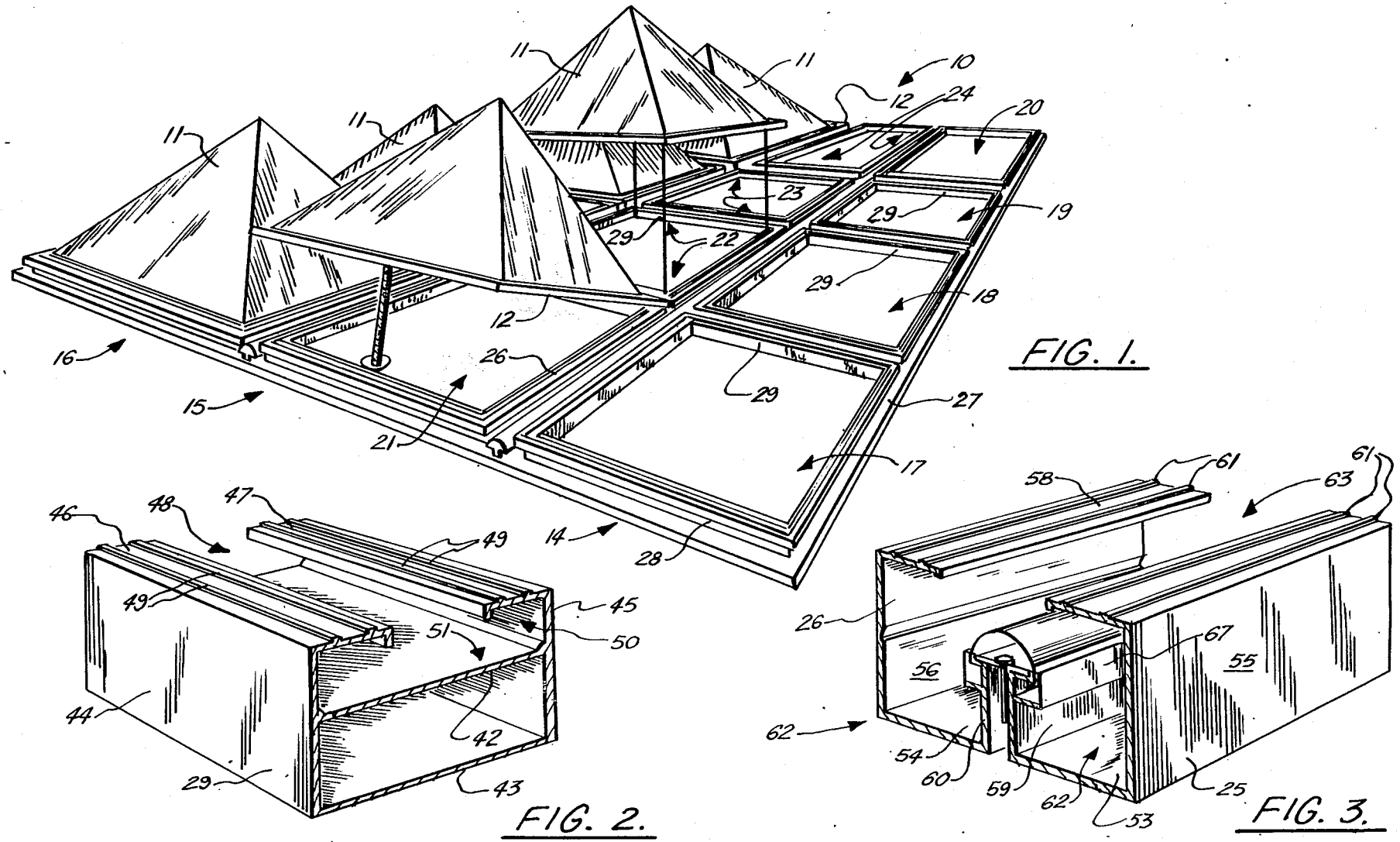
FIG. 1 is a prespective view of the preferred embodiment of apparatus of the present invention.
FIG. 2 is a partial, perspective view of the cross gutter beam portion of the preferred embodiment of the apparatus of the apparatus of the present invention.
FIG. 3 is a partial, perspective view of the preferred embodiment of the apparatus of the present invention illustrating the main gutter portion thereof.

FIG. 1 illustrates generally the preferred embodiment of the apparatus of the present invention designated generally by the numeral 10. Grid skylight apparatus 10 includes a plurality of individual skylights 11, each having a peripheral support 12 and a plastic dome which can be a double dome skylight construction that includes spaced apart plastic domes 11A, 11B (see FIGS. 5–7). An underlying grid 13 supports the individual skylights 11 so that the skylights 11 can be individually installed, individually operated (vented) and/or individually replaced in the event of breakage. The skylight 11 covering bay 21 is shown as operated to an open vented position. Mechanical operators to open/-close individual skylights 11 are commercially available, conventional devices.

The grid 13 includes a plurality of grid row frames 14, 15, 16. Each grid row frame is preferably prefabricated of a plurality of interconnected longitudinal and transverse beam supports. The beam supports define a plurality of bays. In FIG. 1, the grid row frame 14 includes bays 17, 18, 19, and 20, while the grid row frame 15 includes bays 21, 22, 23, and 24, as examples. The grid row frames 14, 15, 16 can be easily prefabricated and stacked during shipment to a job location. They are then field-assembled as will be explained more fully hereinafter. The individual grid row frames 14, 15, 16 are preferably of welded, extruded aluminum construction. Upon assembly, the grid row frames 14, 15 and 16 form a series of higher cross gutters that drain into lower, longitudinal main gutters. Rainwater from the individual skylights 11 drains into both the cross gutters and the main gutter to eliminate the formation of standing water, a source of potential leakage.

By prefabricating the individual grid row frames 14, 15, 16, easy job site handling and easy installation is achieved. The individual grid row frames 14, 15, 16 are installed upon a structural support curb 30 (such as a brick or concrete wall) and mating faces of adjoining grid row frames 14, 15, 16 are connected and made watertight with a continuous gasket. The preassembled skylight units 11 are then assembled upon upper curb surfaces provided by the interconnected longitudinal and transverse beams. FIGS. 2 and 3 show detailed cross-sections of the transverse and longitudinal beams respectively.

Figure 5:
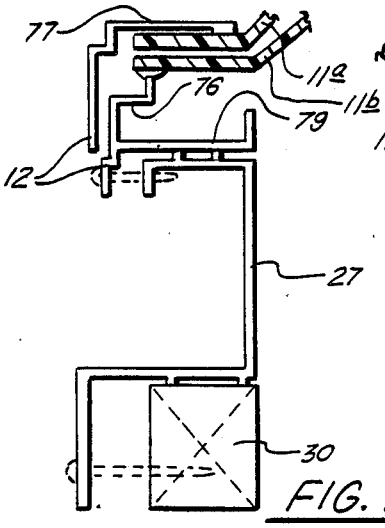
FIG. 5 is a sectional view of the preferred embodiment of the apparatus of the present invention illustrating the curb rail portion thereof.
Figure 6:
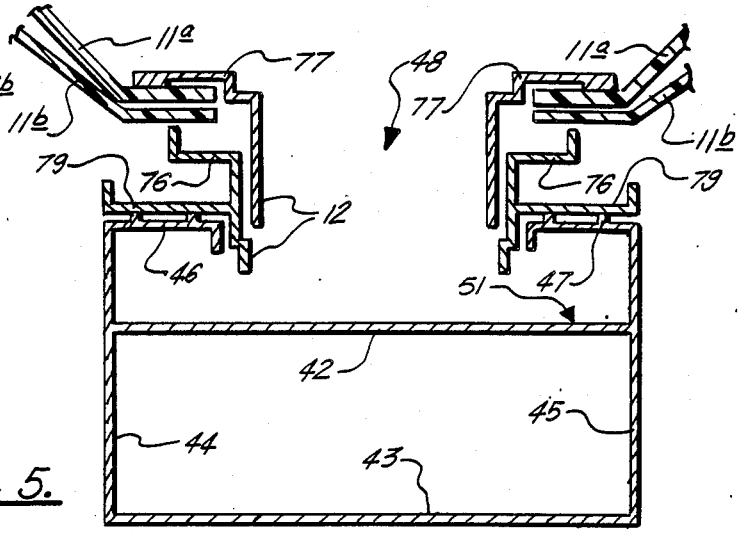
FIG. 6 is a sectional view of the preferred embodiment of the apparatus of the present invention showing a beam and two adjacent skylights.
Figure 7:
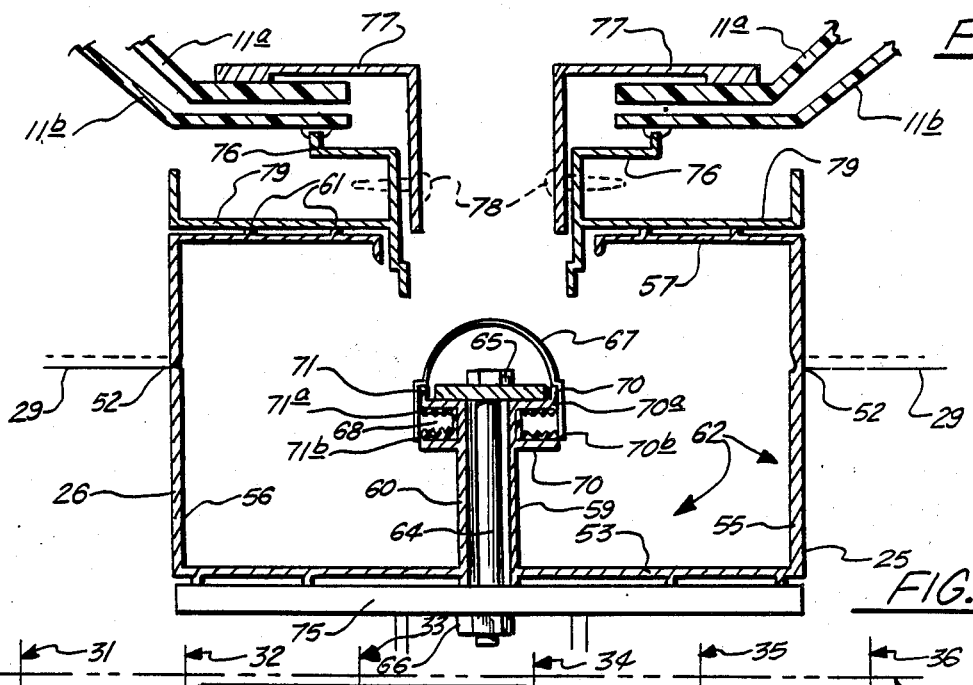
FIG. 7 is a sectional view of the preferred embodiment of the apparatus of the present invention illustrating the main gutter section, and two adjacent skylights.
Figure 4:
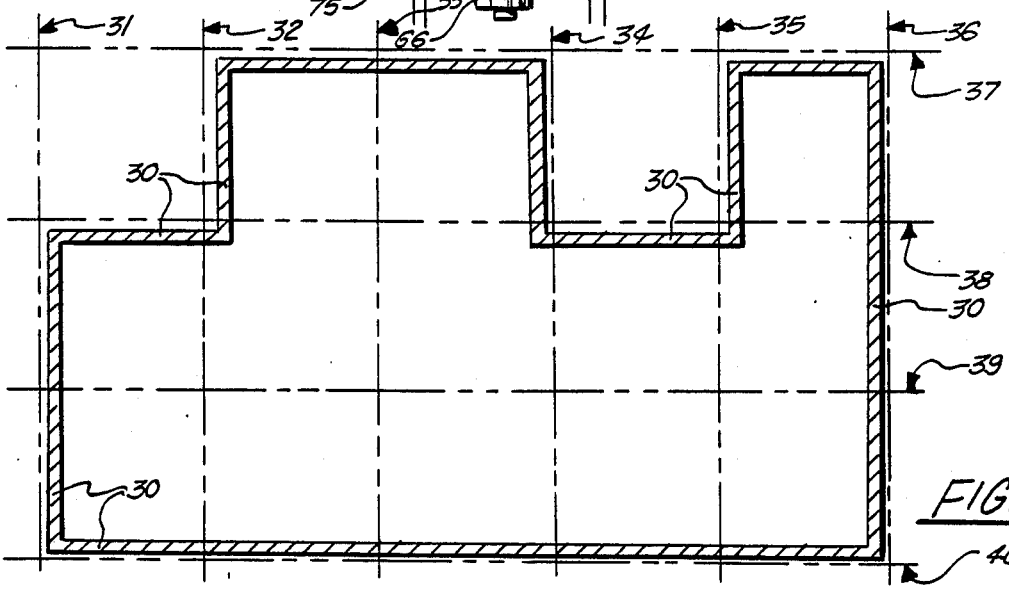
FIG. 4 is a schematic plan view of the preferred embodiment of the apparatus of the present invention illustrating an exemplary installation showing the perimeter curb position, individual bays, and beam positions layout.

FIGS. 1–3 show interior longitudinal beams 25, 26 joined together to form open flow channels 62 (see FIG. 7). Peripheral, longitudinal beam 27 and peripheral, transverse beam 28 define the perimeter of skylight system 10 and are mounted upon the exterior perimeter curb 30 (FIGS. 1, 4 and 5). A sample grid arrangement for the skylight system of the present invention is seen in FIG. 4 wherein longitudinal lines 31–36 and transverse lines 37–40 define the positions of longitudinal beams 25–27, and of transverse beams 28, 29 with respect to curb 30. FIG. 5 is a sectional detail at curb 30 along, for example, line 31, 36, or 40. FIG. 6 illustrates transverse beam 29 providing cross flow gutter channel 50 which occupies, for example, transverse line 40, while FIG. 7 illustrates the connection of longitudinal beams 25, 26 to form open flow main channel 62.

Figure 8:
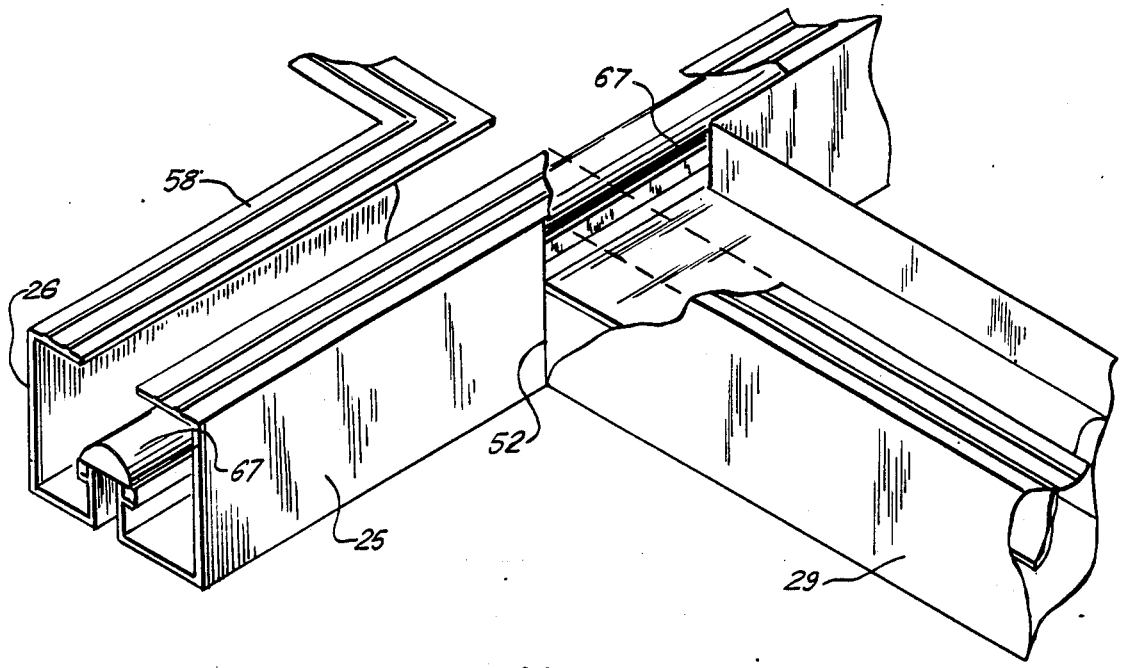
FIG. 8 perspective, fragmentary view of the preferred embodiment of the apparatus of the present invention illustrating the intersection of a cross gutter and main gutter.
Figure 9:
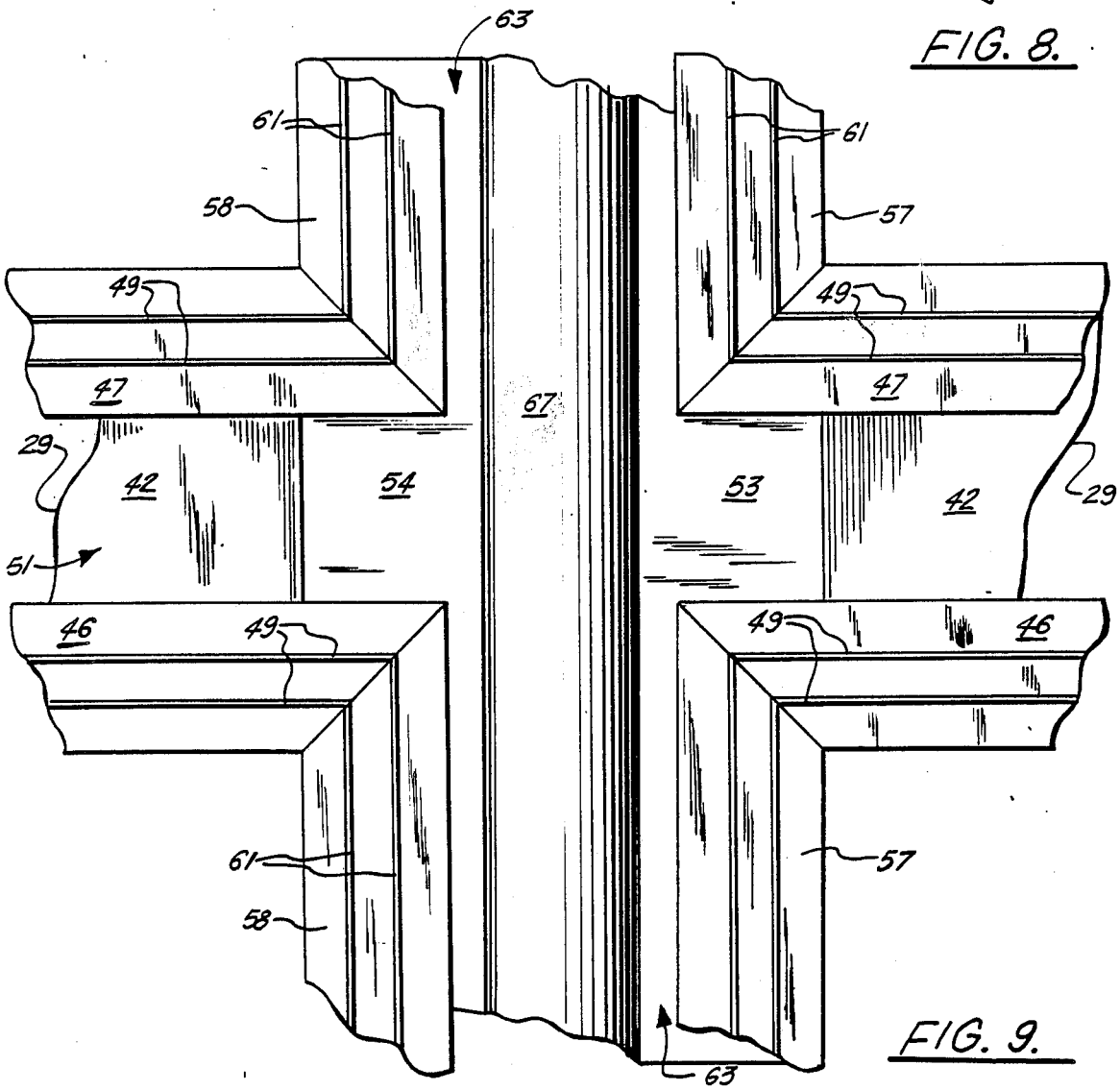
FIG. 9 is a top fragmentary view of the preferred embodiment of the apparatus of the present invention illustrating the intersection of a main gutter and two cross gutters.

Interior transverse beam 29 (FIGS. 2 and 6) includes a pair of vertically spaced, horizontal flanges 42, 43 and a pair of horizontally spaced, vertical side walls or webs 44, 45. Inwardly extending flanges 46, 47 provide upper ribbed surfaces 49 which are receptive of the peripheral support 12 of skylight 11. Horizontal flange 42 defines cross flow gutter channel 50 which is an open flow channel having a lower horizontal surface 51. Transverse beam 29 is attached by shop welding or mechanically fastened, for example, to longitudinal beams 25, 26 (FIGS. 8 and 9). A space 48 is provided between flanges 46, 47 so that the peripheral support 12 of each skylight 11 can extend downwardly into the space 48 (FIG. 6). Rainwater can thus flow from skylight 11 directly into the channel 50. Further, the space 48 between flanges 46, 47 insures that individual skylights 11 will not be touching or connected, but can be individually installed, operated or replaced as desired.

Longitudinal beams 25, 26 (FIGS. 3, 7) each provide bottom flanges 53, 54, and interior vertical webs 55, 56. Webs 55, 56 are joined respectively to top flanges 57, 58 in an integral fashion. Assembly flanges 59, 60 extend upwardly from bottom flanges 53, 54 and provide cooperating mating faces 75, 76 which are held in position with respect to each other with a plurality of fasteners 64–66.

Flanges 57, 58 are provided with ribbed surfaces 61 that are receptive of the peripheral support 12 of each skylight 11. An open space 63 is provided between flanges 57, 58 and also between skylights 11 mounted therein (FIG. 7) so that access is provided to assembly flanges 59, 60 for perfecting a connection therebetween during assembly of two adjacent grid row frames 14, 15, 16. Assembly of longitudinal beams 25, 26 is perfected by using a plurality of spaced apart fasteners that include bolt 64, nut 66, and assembly plate 65. The connection of bolt 64 to an underlying foundation 65 such as a wooden support, steel beam, or the like is perfected with a threaded connection of bolt 64 and nut 66. Plate 65 can be, for example, an elongated plate which extends a distance along the top of assembly flanges 59, 60. An elongated gasket 67 can be, for example, a continuous EPDM gasket having a pair of tongues 68, 69 which register with the spaced apart toothed portions 70 and 71 of assembly flanges 59, 60. Tooth portions 70, 71 have inwardly extending shoulders or raised portions 70A, 70B and 71A, 71B which retain gasket tongues 68, 69 interior of the tooth portions 70, 71. Stops 73, 74 of assembly webs 59, 60 define the lateral position of each web 59, 60 by registering the stops 73, 74 on each side of plate 65. Longitudinal beams 25, 26 and transverse beams 29 can be elongated extruded sections such as extruded aluminum. Similarly, perimeter beams 27, 28 can be elongated extruded aluminum sections. The toothed portions 70, 71 and the stops 73, 74 can be extruded aluminum sections formed integrally with flanges 59, 60.

Skylights 11 are conventional and include typically a pair of skylight panels 11A, 11B to form a double dome skylight, for example. The peripheral support 12 is also of conventional instruction and includes flanged portions 76, 77, 79. Assembly screws 78 can be, for example, sheet metal screws, rivets or the like. Upon assembly, the flange 79 rests upon the skylight curbs which comprise upper flanges 57, 58 of beams 25, 26, and upper flanges 46, 47 of transverse beam 29. This construction is best seen in FIG. 9 wherein the upper flanges 46, 47 have mitered end portions. Similar corresponding mitered end portions are provided on upper flanges 58 as shown in FIG. 9. This mitered end can be welded, for example. The result is a rectangular or square skylight curb formed of four upper flanged portions of beams 25, 26 or 29.

Skylights 11 can be secured against uplift by simply using double sided adhesive tape, for example, which would be placed upon the upper ribbed surfaces of flanges 46, 47 and 57, 58. The flange 79 of skylight peripheral support 12 would be placed directly against such double adhesive tape in order to prevent uplift, if desired, where windy conditions might be expected. Alternatively, any other suitable fastener such as a plurality of rivets or sheet metal screws could be used or a bolted connection or the like.

The foregoing description of the invention is illustrative and explanatory thereof, and various changes in the size, shape and types of materials, as well as in the details of the illustrated construction, may be made without departing from the spirit of the invention and the scope of the claims.

What is claimed as invention is:

1. A grid skylight apparatus skylight apparatus comprising:

a. a plurality of grid row frames having abutting side portions, each grid row frame comprising a plurality of connected beam supports defining a plurality of bays and with bay upper surfaces forming spaced apart skylight curbs that respectively support a plurality of skylights in a spaced apart relationship so that a selected skylight can be separately replaced, the side portions of each grid row frame providing mating edges that can register with the mating edge of an adjacent grid row frame during assembly;

b. a plurality of skylights each having a peripheral support skirt that seats respectively upon a bay at the skylight curb associated therewith, and a light transmitting skylight panel covering the peripheral support skirt;

c. a plurality of cross gutters on each grid row frame positioned between adjacent skylights, and extending at an angle toward the mating edge of the grid row frame;

d. a cross flow channel surface on the cross gutter having an elevation lower than the bay upper surfaces defining the skylight curbs;

e. a main gutter channel formed by an assembly of the mating edges of two adjacent grid row frames and including a pair of longitudinally extending gutter sections, each having a main gutter channel surface with an elevation lower than the elevation of the cross flow channel surface;

f. the gutter sections including a beam support flange defining one side of each bay and an assembly flange extending upwardly from the main gutter channel surface, terminating at a position spaced from the skylights;

g. discharge means for transmitting rainwater flow between the cross gutters and the main gutter channel;

h. fastening means for assembling the grid row frame mating edges, and spaced from the skylights so that skylights can be changed without disassembly of the fastening means; and i. seal means for preventing rainwater leakage at the mating edges of adjacent grid row frames.

2. The grid skylight support apparatus of claim 1, wherein the main gutter comprises a pair of longitudinal beams each having a cross section that includes an upper flange comprising in part the skylight curbs for supporting the skylights, a lower flange defining the bottom of the main gutter channel, an inner vertical web extending between the upper flange and the lower flange, and a generally vertical assembly flange transversely spaced from the inner vertical web, the assembly flanges including the mating edges.

3. The grid skylight support apparatus of claim 2, wherein each assembly flange extends from the lower flange and terminates at an elevational position below the upper flange.

4. The grid skylight support apparatus of claim 1, wherein each grid row frame is a self-supporting structural beam grid.

5. The grid skylight support apparatus of claim 2, wherein the seal means includes a continuous longitudinal gasket that extends between the assembly flanges of adjacent longitudinal beams of adjacent assembled grid rows.

6. The grid skylight support apparatus of claim 1, wherein each grid row comprises a plurality of interconnected longitudinal and transverse beam supports, each having an upper flange that occupies the same plane to define the skylight curbs.

7. The grid skylight support apparatus of claim 6, wherein the longitudinal beams and transverse beams intersect at right angles and each have upper, connected horizontal flanges forming rectangular skylight curbs upon which the skylight peripheral support member registers.

8. The grid skylight support apparatus of claim 1, wherein each cross gutter comprises a generally U-shaped beam having a pair of spaced apart, upper flanged portions with spaced apart surfaces that define a portion of the skylight curbs for adjacent skylights.

9. The grid skylight support apparatus of claim 8, wherein the main gutter channel upper flanges occupy the same plane as the cross gutter channel flanges.

10. The grid skylight support apparatus of claim 1, wherein the discharge means has an invert elevation equal to or higher than the elevation of the mating edges.

11. The grid skylight support apparatus of claim 1, wherein the main gutter channel is an open channel.

12. The grid skylight support apparatus of claim 11, wherein the mating edges extend laterally beyond the skylight peripheral skirt so that upon assembly there is an access opening between adjacent skylights, exposing the fastening means.

13. The grid skylight support apparatus of claim 1 or 12, wherein the fastening means includes a plurality of spaced, bolted connections.

14. The grid skylight support apparatus of claim 12, wherein the main gutter channel is an open flow channel that can receive rainwater flow directly from skylights through the access opening.

* * * * *